US011488765B2

(12) United States Patent
Feist et al.

(10) Patent No.: US 11,488,765 B2
(45) Date of Patent: Nov. 1, 2022

(54) ELECTRICAL COMPONENT, COMPONENT ARRANGEMENT AND METHOD FOR PRODUCING A COMPONENT ARRANGEMENT

(71) Applicant: TDK Electronics AG, Munich (DE)

(72) Inventors: Günter Feist, Fils (DE); Karsten Frey, Giengen An der Brenz (DE)

(73) Assignee: TDK ELECTRONICS AG, Munich (DE)

( * ) Notice: Subject to any disclaimer, the term of this patent is extended or adjusted under 35 U.S.C. 154(b) by 602 days.

(21) Appl. No.: 16/498,308

(22) PCT Filed: Mar. 22, 2018

(86) PCT No.: PCT/EP2018/057308
§ 371 (c)(1),
(2) Date: Sep. 26, 2019

(87) PCT Pub. No.: WO2018/177883
PCT Pub. Date: Oct. 4, 2018

(65) Prior Publication Data

US 2020/0176172 A1 Jun. 4, 2020

(30) Foreign Application Priority Data

Mar. 31, 2017 (DE) ..... 102017106970.4

(51) Int. Cl.
*H01F 27/28* (2006.01)
*H01F 27/06* (2006.01)
*H01F 27/29* (2006.01)

(52) U.S. Cl.
CPC ..... *H01F 27/2828* (2013.01); *H01F 27/06* (2013.01); *H01F 27/292* (2013.01); *H01F 2027/065* (2013.01)

(58) Field of Classification Search
CPC ..... H01F 27/06; H01F 2027/065
See application file for complete search history.

(56) References Cited

U.S. PATENT DOCUMENTS

| | | | | |
|---|---|---|---|---|
| 4,602,235 | A | 7/1986 | Howard et al. | |
| 7,142,084 | B2 | 11/2006 | Cheng | |
| 2006/0001517 | A1 | 1/2006 | Cheng | |
| 2007/0216512 | A1* | 9/2007 | Sano | H01F 17/043 336/212 |
| 2009/0256666 | A1* | 10/2009 | Shieh | H01F 27/027 336/229 |
| 2010/0013587 | A1 | 1/2010 | Yan et al. | |
| 2013/0033348 | A1 | 2/2013 | Saito et al. | |

(Continued)

FOREIGN PATENT DOCUMENTS

| | | | |
|---|---|---|---|
| DE | 102006026364 | A1 | 8/2007 |
| DE | 102015107605 | A1 | 11/2016 |

(Continued)

*Primary Examiner* — Sherman Ng
(74) *Attorney, Agent, or Firm* — Slater Matsil, LLP

(57) ABSTRACT

An electrical component, a component arrangement and a method for producing a component arrangement are disclosed. In an embodiment an electrical component includes a coil form and a winding of a wire around the coil form and a connection area comprising a wire end of the wire, wherein the connection area is configured to latch with a mounting facility.

17 Claims, 6 Drawing Sheets

(56) References Cited

U.S. PATENT DOCUMENTS

| | | | | |
|---|---|---|---|---|
| 2014/0266541 | A1* | 9/2014 | Sakamoto | H01F 27/24 29/606 |
| 2016/0086725 | A1* | 3/2016 | Igarashi | H01F 27/2823 336/83 |
| 2016/0336846 | A1 | 11/2016 | Walczak et al. | |
| 2017/0032888 | A1* | 2/2017 | Park | H01F 27/325 |

FOREIGN PATENT DOCUMENTS

| | | | |
|---|---|---|---|
| JP | 2003257749 | A | 9/2003 |
| JP | 2007250864 | A | 9/2007 |
| JP | 2008041924 | A | 2/2008 |
| JP | 2009177148 | A | 8/2009 |

* cited by examiner

ELECTRICAL COMPONENT, COMPONENT ARRANGEMENT AND METHOD FOR PRODUCING A COMPONENT ARRANGEMENT

This patent application is a national phase filing under section 371 of PCT/EP2018/057308, filed Mar. 22, 2018, which claims the priority of German patent application 102017106970.4, filed Mar. 31, 2017, each of which is incorporated herein by reference in its entirety.

TECHNICAL FIELD

The present invention relates to an electrical component comprising a winding of a wire. In particular, it relates to an inductive component such as an inductor or a transformer.

BACKGROUND

Such components are mounted on a printed circuit board, for example, via PTH (pin-through-hole) mounting. For flexible mounting, SMD mounting, i.e., surface-mounting technology, would be advantageous; however, it is difficult to produce in a reliable manner, in particular in the case of thick wires. Here, the problem with thick wires is often the insufficient coplanarity of connection areas of the wires.

SUMMARY OF THE INVENTION

Embodiments provide an electrical component having improved characteristics.

According to a first aspect, an electrical component is specified which comprises a coil form and a winding of a wire around the coil form. The component is in particular an inductive component, for example, an inductor or a transformer.

The component has a connection area, wherein the connection area comprises a wire end of the wire. The connection area is in particular configured for electrically connecting the component to a connection facility, for example, a printed circuit board. The connection area is configured for latching with a mounting facility. For example, the mounting facility is configured as a plate. The component may have several such connection areas.

Surface mounting of the component on the connection facility is made possible by latching the connection area with the mounting facility. In particular, the position of the connection area can be determined by latching the connection area with the mounting facility. In the case of several connection areas which are latched with the mounting facility, it may be ensured that the connection areas lie in a plane. Thus, it is possible to produce planarity which is required for the surface mounting.

For example, the wire has a thickness of at least 1.5 mm. In the case of such thick wires, it is difficult to achieve surface mounting via conventional methods. However, the wire may also have a lesser thickness, depending on the size and weight of the component.

For example, the connection area is spaced downwardly away from the coil form, so that an arrangement of a mounting facility between the coil form and the connection area is possible. In this case, the mounting facility may be clamped between the winding or the coil form and the connection area. In particular, the mounting facility may be pressed by the connection area to the winding or the coil form. In this way, it may be achieved that the connection area rests tightly against the mounting facility and is thus particularly well fixed in its position.

For example, the connection area has a latching edge for latching with a mounting facility. The connection area may additionally or alternatively have an indentation. The indentation may be configured for accommodating a portion of the mounting facility. By means of the latching edge and/or indentation, a positionally accurate latching of the connection area with the mounting facility can take place.

In one embodiment, the wire end is configured directly for latching with the mounting facility. In particular, the latching edge and/or the indentation may be formed directly by the wire end. For example, the wire end has a cross-sectional shape which is different from that of a wire area which is adjacent to it. For example, the wire end has a flat side, wherein an adjacent wire area is round.

For example, the modified shape of the wire end is produced by reshaping the wire end, for example, crimping it. As a result, the connection area can be configured for latching in a particularly simple and economical manner.

In one embodiment, the component has a connecting piece which is attached to the wire end and which is configured for latching with the mounting facility. In particular, the connecting piece can provide a latching edge.

The connecting piece surrounds, for example, the wire end. In particular, it may be a metallic strip (splice). It may also be a sleeve. The connecting piece is, for example, attached to the wire end by means of a clamping connection or crimp connection. In this way, a connection area which is suitable for latching may be produced by means of a connecting piece which is economical and simple to mount.

According to a further aspect of, a component arrangement is specified which comprises the component described above and a mounting facility which is latched with the component. In particular, the latching is produced by means of the connection area.

In particular, the mounting facility is configured in such a way that in the case of several connection areas which are latched with the mounting facility, the connection areas are arranged in a plane. In this way, reliable surface mounting of the connection areas is made possible. For example, the mounting facility is configured as a plate.

The connection area rests, for example, against a lower side of the mounting facility, and the coil form rests against an upper side of the mounting facility. The mounting facility is in particular clamped between the connection area and the coil form and/or the winding.

The mounting facility may have one or more latching areas which, for example, are configured as openings or recesses in the lower side of the mounting facility. The latching areas are in particular configured for latching with the one or several connection areas.

According to a further aspect, an arrangement is specified which is made up of the component arrangement described above and a connection facility. The connection facility is, for example, configured as a printed circuit board. The component arrangement is in particular attached to the connection facility using surface mounting.

According to another aspect, a method for producing a component arrangement is specified. In this case, a component as described above and a mounting facility are provided. The mounting facility is arranged between the connection area of the component and the coil form or the winding. In this case, latching of the connection area with the mounting facility is produced.

In order to produce the latching, the connection area, for example, is bent away from the coil form, and then snaps resiliently into the mounting facility. In this way, the mounting facility is pressed against the coil form and/or the winding.

Furthermore, embodiments provide a method for surface mounting the component described above. In this case, a component arrangement is formed which comprises the component and a mounting facility. A connection facility, for example, a printed circuit board, is provided. The connection area of the component arrangement is placed on the printed circuit board and connected to the printed circuit board. For example, the connection area is soldered to the printed circuit board.

In the present disclosure, several embodiments of the present invention are described. All characteristics which are disclosed with respect to the component, the component arrangement, the arrangement made up of the component arrangement and the connection facility, or the method, are also correspondingly disclosed with respect to the other aspects, even if the respective characteristic is not explicitly mentioned in the context of the other aspects.

Furthermore, the description of the subject matter which is specified here is not limited to the individual particular embodiments. Rather, the features of the individual embodiments may be combined with one another, to the extent that this is technically feasible.

BRIEF DESCRIPTION OF THE DRAWINGS

The subject manner described here will be explained in greater detail based on schematic exemplary embodiments.

The following is depicted.

In the following figures, identical reference characters preferably refer to functionally or structurally corresponding parts of the various embodiments.

DETAILED DESCRIPTION OF ILLUSTRATIVE EMBODIMENTS

Figure 1A:
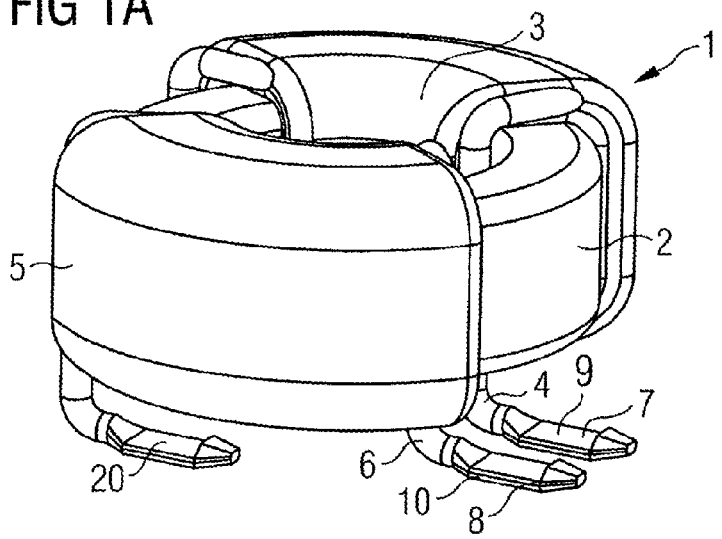
FIG. 1A depicts a lateral perspective view of a first embodiment of an electrical component.

FIG. 1A depicts an electrical component 1 comprising a coil form 2, around which a winding 3 of a wire 4 is arranged. The winding 3 is schematically depicted having a planar shape. The component 1 is configured as an inductive component, in particular as an inductor. It may also be a transformer.

The coil form 2 is configured as a magnetic core, in particular as a ferrite core. It is presently a closed core, in particular a ring core. Other shapes and types of coil forms are possible. For example, it may be a mushroom core, a cylinder core, or a D-core.

The component 1 may have several windings 3, 5 of wires 4, 6. Presently, two windings 3, 5 are present which are respectively formed from a wire 4, 6. Fewer or more windings and wires may be present. For example, it may be a single-conductor, a two-conductor, a three-conductor, a four-conductor, or a five-conductor component.

The wires 4, 6 are, for example, configured as relatively thick wires, in particular having a diameter greater than 1.5 mm. For example, the wires have a diameter of 2 mm. The wires 4, 6 have, for example, a round cross-sectional shape. For example, each wire is a copper wire, in particular an enameled copper wire. The wires 4, 6 may also have a lesser thickness.

Figure 2A:
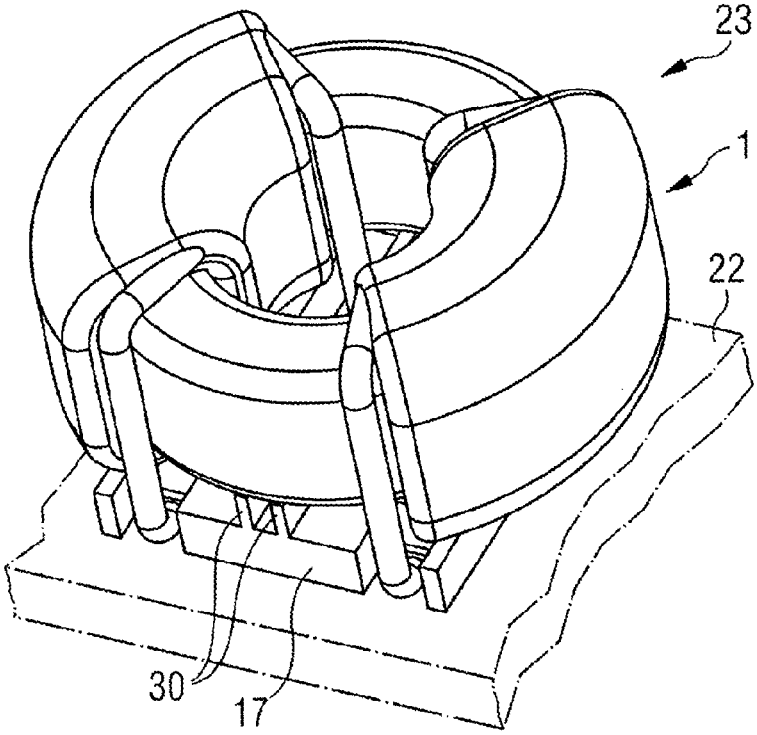
FIG. 2A depicts a perspective view of a first embodiment of a component arrangement, viewed diagonally from above.
Figure 2B:
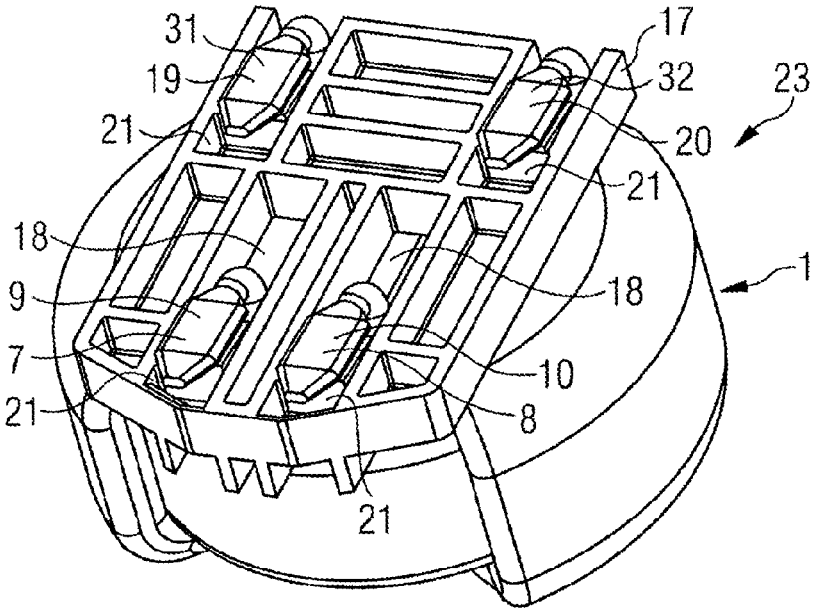
FIG. 2B depicts a perspective view of the component arrangement from FIG. 2A, viewed diagonally from below.

The component 1 has several connection areas 7, 8, 19, 20 (see also FIG. 2B). Only two connection areas 7, 8 are described in detail below; however, the embodiments also apply correspondingly to the further connection areas 19, 20. The connection areas 7, 8 are respectively formed from a wire end 9, 10. The connection areas 7, 8 are configured for surface mounting (SMD) on a connection facility 22 (see FIG. 2A), for example, a printed circuit board.

The connection areas 7, 8 protrude downwards from the winding 3, 5 and the coil form 2. In particular, the connection areas 7, 8 are spaced apart from the coil form 2 and the windings 3, 5. The wire ends 9, 10 are reshaped and bent in order to form the connection areas 7, 8.

Figure 1B:
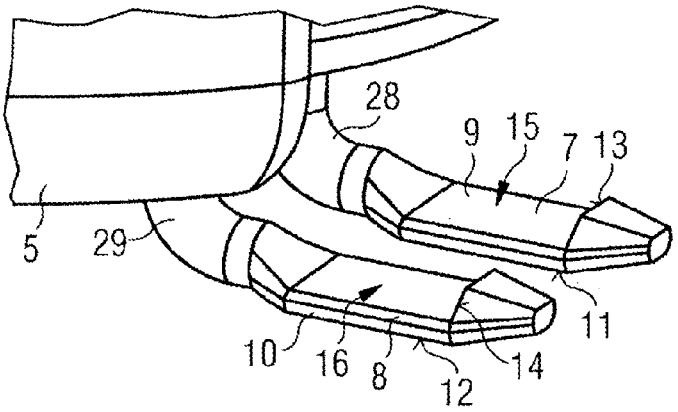
FIG. 1B depicts an enlarged representation of connection areas of the embodiment from FIG. 1A.

FIG. 1B shows an enlarged view of the connection areas 7, 8 from FIG. 1A. The connection areas 7, 8 have flat lower sides 11, 12 which are mountable on a connection facility using SMD mounting. The connection areas 7, 8 are configured in the shape of connection feet.

The wire ends 9, 10 are reshaped for forming the connection areas 7, 8, for example, by means of crimping. The wire ends 9, 10 have a cross-sectional shape which is different from that of adjacent wire areas 28, 29, in particular wire areas within the winding. The wire ends 9, 10 do not have a round cross-sectional shape. In the case of the described embodiment, the connection areas 7, 8, 19, 20 may be made up of the wire ends 9, 10, so that no other elements are needed for mounting.

Figure 1C:
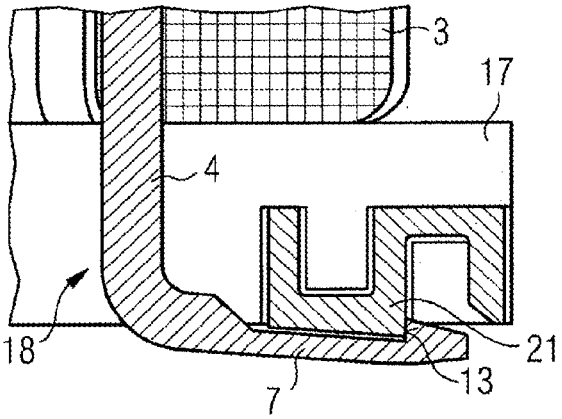
FIG. 1C depicts a sectional view of a latching of a connection area from FIGS. 1A and 1B with a latching facility.

The wire ends 9, 10 and thus also the connection areas 7, 8 respectively have a latching edge 13, 14 for latching with a mounting facility 17 (see FIG. 1C). The latching edge 13, 14 is formed by reshaping the wire ends 9, 10. The wire ends 9, 10 have in particular the shape of latching hooks. Furthermore, an indentation 15, 16 is provided in each case for accommodating an area of the mounting facility 17. The indentations 15, 16 have, for example, flat surfaces.

FIG. 1C depicts a lateral view of a latching of one of the connection areas 7 with a mounting facility 17. The mounting facility 17 is, for example, configured as a plate. It may in particular be a grid plate. The further connection areas 8, 19, 20 are correspondingly latched with the mounting facility 17.

The connection area 7 protrudes downward from the winding 3 in such a way that the mounting facility 17 can be accommodated between the connection area 7 and the winding 3 or the coil form 2. The mounting facility 17 has an opening 18 through which the wire 4 is routed.

On the lower side of the mounting facility 17, a latching area 21 is configured for latching with the connection area 7, in particular with the latching edge 13. The latching area 21 has wedge-shaped contours which enable latching with the connection area 7. The connection area 7 is resilient. In order to latch with the mounting facility 17, the connection area 7 is bent open somewhat and then snaps resiliently into the mounting facility 17. The mounting facility 17 is pressed onto the winding 3 and/or the coil form 2 by the connection area 7 and is thus clamped between the connection area 7 and the winding 3 and/or the coil form 2.

The mounting facility 17 thus constitutes a coplanar arrangement of the connection areas 7, 8, 19, 20, whereby reliable SMD mounting is made possible. Due to their resilient pre-tensioning, the connection areas 7, 8, 19, 20 rest against the mounting facility 17. The latching areas 21 of the mounting facility 17 are configured in such a way that a flat arrangement of the connection areas 7, 8, 19, 20 is produced. The arrangement of the connection areas 7, 8, 19, 20 ensures a sufficient footprint and contact surface for the SMD mounting.

In this way, SMD mounting is made possible in particular for components having relatively thick wires. In addition, a separate SMD connection pin, to which the wires 4, 6 must be attached, is not necessary. The mounting facility 17 is attached by simply latching with the component 1.

FIGS. 2A and 2B depict a first embodiment of a component arrangement 23 comprising a component 1 and a mounting facility 17, viewed diagonally from above and diagonally from below. The component 1 may be configured according to FIGS. 1A to 1C, and the mounting facility 17 may be configured according to FIG. 1C. The mounting facility 17 has, for example, ribs 30 on which the coil form 2 rests.

In addition, a connection facility 22 to which the component arrangement 23 can be attached is indicated by dashed lines. FIG. 2A thus also depicts an arrangement comprising a component arrangement 23 and a connection facility 22, wherein the component arrangement 23 is attached to the connection facility 22 using surface mounting.

The mounting facility 17 is clamped to the component 1 by means of the connection areas 7, 8, 19, 20 (FIG. 2B), and the connection areas 7, 8, 19, 20 are arranged in a coplanar manner. Thus, all connection areas 7, 8, 19, 20 are at the same height position. As a result, the component 1 can be arranged on a planar connection facility 22 in such a way that all connection areas 7, 8, 19, 20 rest on the connection facility 22, and the component 1 does not wobble. In this way, the component arrangement 23 can be attached to the connection facility 22 via surface mounting. For example, the component arrangement 23 is soldered to the connection facility 22. The connection facility 22 may be configured as a printed circuit board.

The connection areas 7, 8, 19, 20 are thus simultaneously configured for latching with the mounting facility 17 and for forming an electrical and mechanical connection to the connection facility 22. In particular, the upper sides of the connection areas 7, 8, 19, 20 are configured for latching, and the lower sides of the connection areas 7, 8, 19, 20 are configured for electrical connection.

As is apparent in FIG. 2B, the mounting facility 17 has several openings 18, through which the connection areas 7, 8 are passed for mounting. The further connection areas 19, 20 are guided past a rear side of the mounting facility 17. Subsequently, the component 1 is displaced laterally with respect to the mounting facility 17, so that the connection areas 7, 8, 19, 20 latch with latching areas 21 of the mounting facility 17. Alternatively, the mounting facility 17 may be moved and the component 1 may be fixed.

The connection areas 7, 8, 19, 20 are, for example, arranged as depicted in FIG. 2B. The first connection area 7 is arranged next to the second connection area 8. The third and fourth connection areas 19, 20 are arranged next to one another and are displaced toward the rear with respect to the first and second connection areas 7, 8. Due to the position of the respective wire ends 9, 10, 31, 32, the first and second connection areas 7, 8 are arranged more closely to one another than the third and fourth connection areas 19, 20.

The first and third connection areas 7, 19 are formed by wire ends 9, 31 of the winding 3, and the second and fourth connection areas 8, 20 are formed by wire ends 10, 32 of the further winding 5.

Figure 3A:
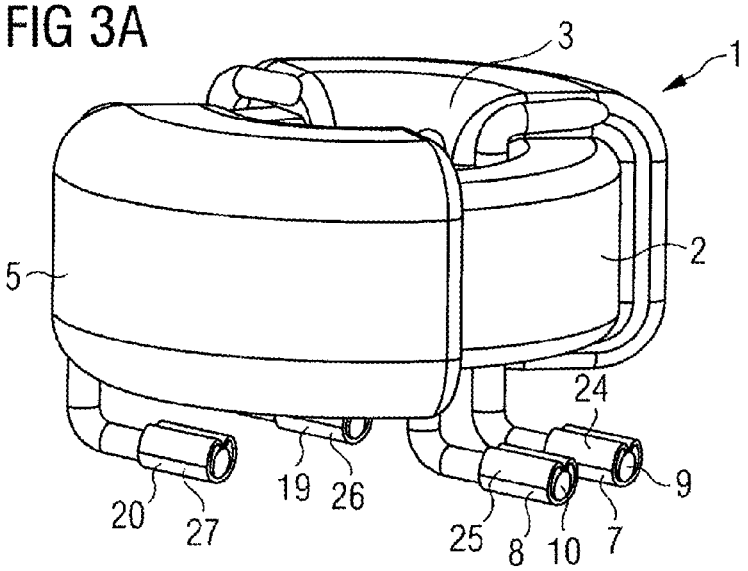
FIG. 3A depicts a lateral perspective view of a second embodiment of an electric component.

FIG. 3A depicts a second embodiment of an electrical component 1. This embodiment differs from the embodiment of FIG. 1A due to the configuration of the connection areas 7, 8, 19, 20.

Only two connection areas 7, 8 are described in detail below; however, the embodiments also apply correspondingly to the further connection areas 19, 20. The connection areas 7, 8 respectively have a wire end 9, 10. Connecting pieces 24, 25 are attached to the wire ends 9, 10. The connecting pieces 24, 25 are, for example, configured as sleeves which are pushed onto the wire ends 9, 10 and are then press-formed in order to attach them to the wire ends 9, 10.

Other connecting pieces 24, 25 are also considered, for example, metallic strips. The strips can be bent around the wire ends 9, 10 and attached to the wire ends 9, 10 by means of a clamping connection or crimp connection. In particular, they may be so-called "splice crimps".

Figure 3B:
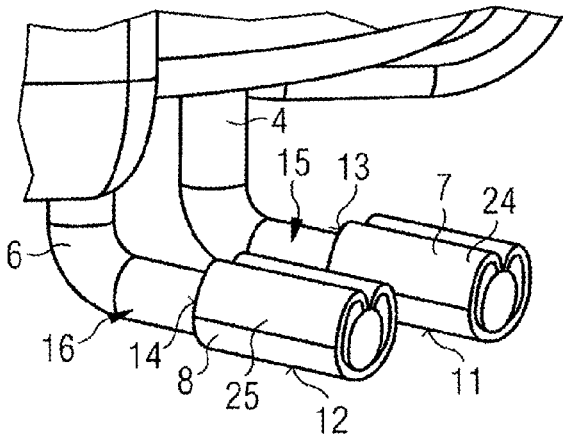
FIG. 3B depicts an enlarged representation of connection areas of the embodiment from FIG. 3A.

FIG. 3B shows an enlarged view of the connection areas 7, 8 from FIG. 1A. The connection areas 7, 8 have lower sides 11, 12 which are suitable for SMD mounting. The lower sides 11, 12 are presently not completely flat, but are slightly curved. However, the lower sides 11, 12 have a sufficient support surface for SMD mounting, in particular due to the connecting pieces 24, 25. In the depicted embodiment, the connecting pieces 24, 25 effectuate a substantial widening of the connection areas 7, 8. The connecting pieces 24, 25 are spaced laterally away from the outer sides of the wire ends 9, 10.

The connecting pieces 24, 25 are configured for latching with a mounting facility 17. In particular, the connecting pieces 24, 25 form latching edges 13, 14 for latching with a mounting facility 17. The connection areas 7, 8 have indentations 15, 16 which are formed by portions of the wires 4, 6 which are adjacent to the latching edges 13, 14.

Figure 3C:
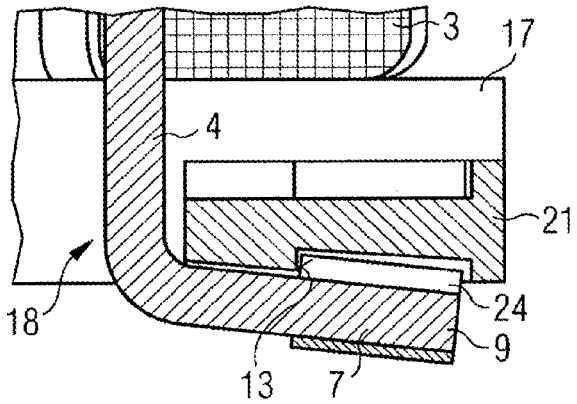
FIG. 3C depicts a sectional view of a latching of a connection area from FIGS. 3A and 3B with a latching facility.

FIG. 3C depicts a sectional view of a latching of one of the connection areas 7 with a mounting facility 17. The latching applies correspondingly to the further connection areas 8, 19, 20.

Here, it is apparent that the wire ends 9, 10 have the same cross-sectional shape as adjacent wire areas 28, 29, in particular a round cross-sectional shape.

The latching with the mounting facility 17 is similar to that in FIG. 1C; however, the latching is produced by means of the connecting piece 24 and not directly by means of the wire end 9. The connecting piece 24 latches with a latching area 21 of the mounting facility 17 via its latching edge 13. The connection area 7 is partially sunk in the mounting facility 17. Here as well, the mounting facility 17 is pressed from the connection area 7 to the winding 3 and/or the coil form 2 and clamped there between.

Corresponding to FIG. 1C, here as well, a coplanar arrangement of the connection areas 7, 8, 19, 20 is achieved, so that SMD mounting is made possible.

Figure 4A:
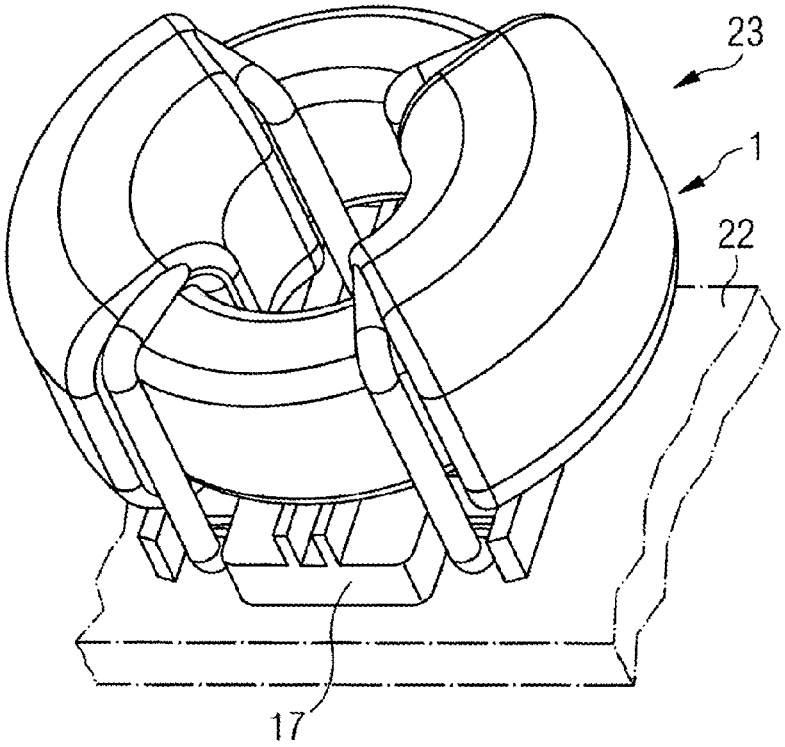
FIG. 4A depicts a lateral perspective view of a second embodiment of an electric component.
Figure 4B:
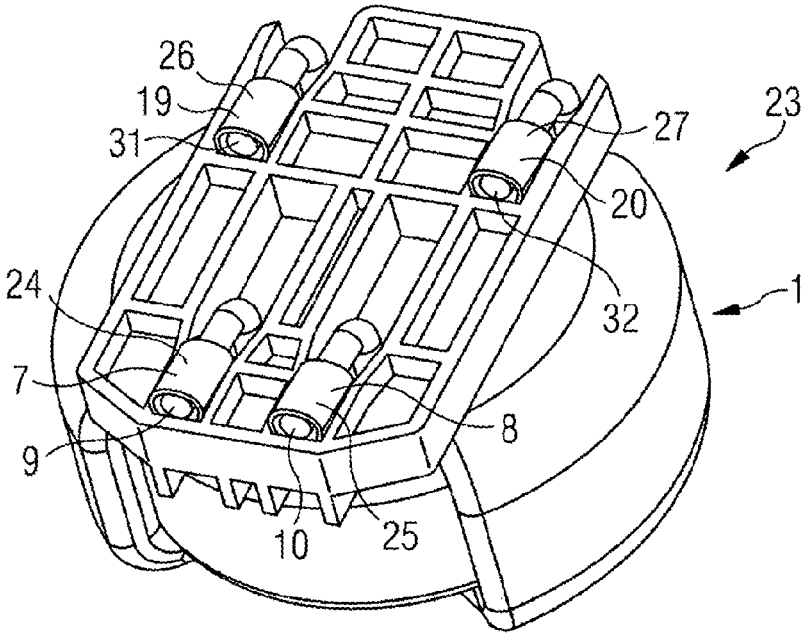
FIG. 4B depicts an enlarged representation of connection areas of the embodiment from FIG. 4A.

FIGS. 4A and 4B depict a second embodiment of a component arrangement 23 comprising a component 1 and a mounting facility 17, viewed diagonally from above and diagonally from below. The component 1 may be configured according to FIGS. 3A to 3C, and the mounting facility 17 may be configured according to FIG. 3C. In addition, a connection facility 22, to which the component arrangement 23 can be attached by means of SDM mounting, is indicated by dashed lines.

Unlike the component arrangement 23 from FIGS. 2A and 2B, the connection areas 7, 8 have connecting pieces 24, 25, 26, 27 which are attached to the wire ends 9, 10, 31, 32.

Figure 5A:
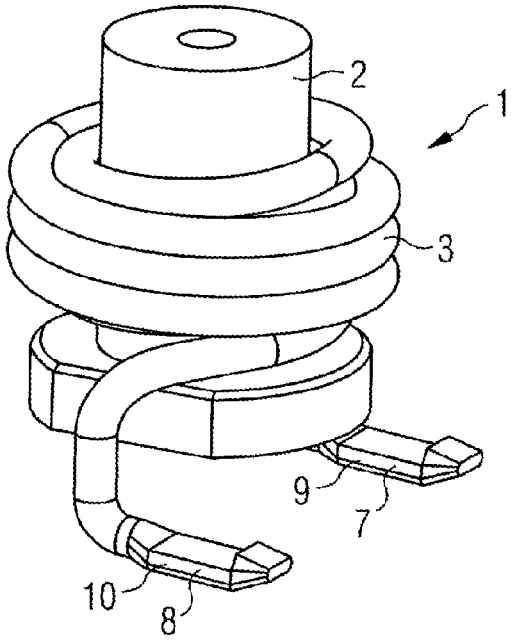
FIG. 5A depicts a lateral perspective view of a further embodiment of an electric component.

FIG. 5A depicts a second embodiment of an electrical component 1. This embodiment differs from the embodiment of FIG. 1A due to the shape of the coil form 2 and the winding 3.

The coil form 2 is configured as a mushroom core. The component 1 may in particular be a mushroom core inductor. A winding 3 is wound around the coil form 2. The wire ends 9, 10 of the winding 3 are configured by means of reshaping and bending as connection areas 7, 8 which are configured corresponding to the connection areas 7, 8 from FIG. 1A.

Figure 5B:
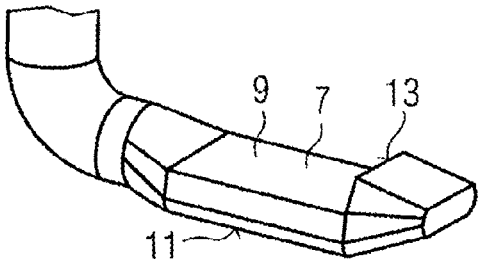
FIG. 5B depicts an enlarged representation of the connection areas of the embodiment from FIG. 5A.

FIG. 5B depicts an enlarged view of a connection area 7 of the embodiment according to FIG. 5A. The connection areas 7 have a latching edge 13 for latching with a mounting facility, and a flat lower side 11 for forming an electrical connection to a connection facility.

Figure 5C:
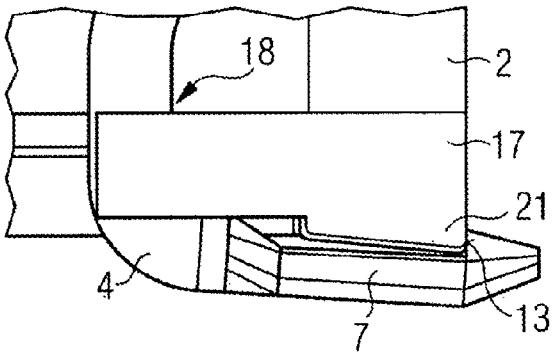
FIG. 5C depicts a lateral view of a latching of a connection area from FIGS. 5A and 5B with a mounting facility.

FIG. 5C depicts a latching of a connection area 7 from FIGS. 5A and 5B with a mounting facility 17. Corresponding to FIG. 1C, the mounting facility 17 has one or several latching areas 21 for latching with the latching edge 13 of the connection area 7. The latching areas 21 may respectively have sloped outer sides.

For mounting the component 1 to the mounting facility 17, the mounting facility 17 is pushed between the connection areas 7, 8 and the coil form 2. To accommodate the wire 4, the mounting facility 17 has lateral openings 18. The connection areas 7, 8 latch with the latching area 21 of the mounting facility 17. Here, the latching area 21 is formed by a lateral outer edge of the mounting facility 17. The connection areas 7, 8 thus protrude laterally over the mounting facility 17. This results in a more compact shape of the mounting facility 17 in comparison to FIG. 1C. There, the mounting facility 17 protrudes laterally over the connection areas 7, 8.

Figure 6A:
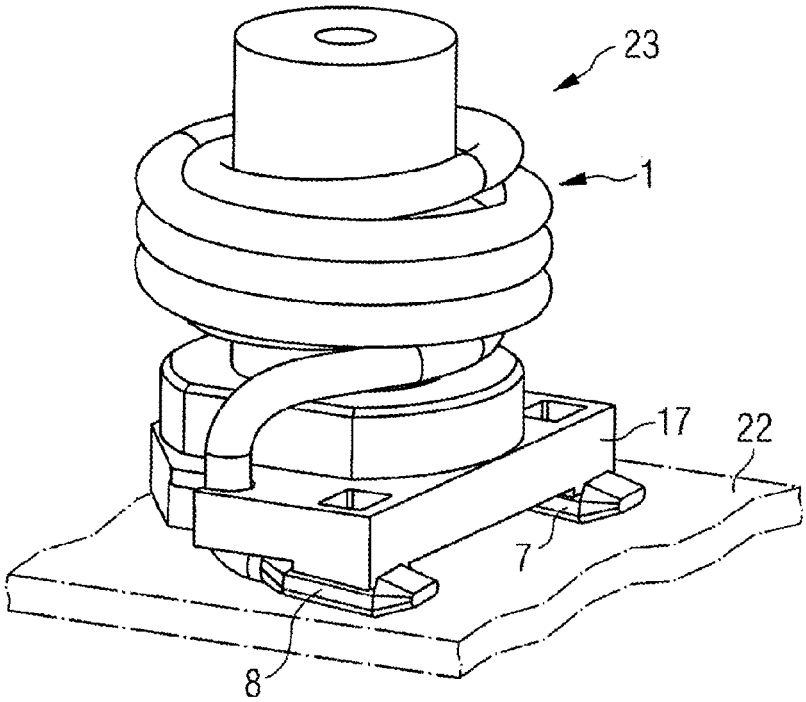
FIG. 6A depicts a lateral perspective view of a further embodiment of a component arrangement.
Figure 6B:
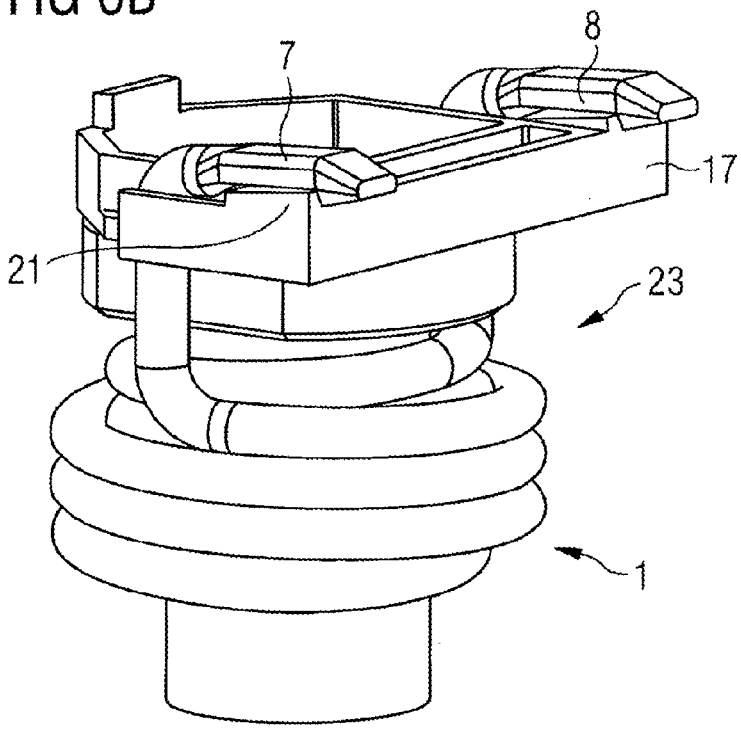
FIG. 6B depicts a further lateral perspective view of the component arrangement from FIG. 6A.

FIGS. 6A and 6B show an additional embodiment of a component arrangement 23 comprising a component 1 and a mounting facility 17, from lateral perspective views. The component 1 may be configured according to FIGS. 5A to 5C, and the mounting facility 17 may be configured according to FIG. 5C.

The connection areas 7, 8 are arranged next to one another and protrude over the mounting facility 17.

Corresponding to Figure A, a connection facility 22, to which the component arrangement 23 can be attached by means of SMD mounting, is indicated by dashed lines.

The invention claimed is:

1. An electrical component comprising:

a coil form and a winding of a wire around the coil form; and a connection area comprising a wire end of the wire, wherein the connection area has a latching edge configured to latch with a mounting facility.

2. The electrical component according to claim 1, wherein the connection area is spaced downwardly away from the coil form so that an arrangement of the mounting facility between the coil form and the connection area is enabled.

3. The electrical component according to claim 1, wherein the wire end is configured to directly latch.

4. The electrical component according claim 1, wherein the latching edge is formed by a change in a cross-section of the wire.

5. The electrical component according to claim 1, further comprising a connecting piece attached to the wire end, wherein the connecting piece is configured to latch.

6. The electrical component according to claim 5, wherein the connecting piece is a metallic strip.

7. The electrical component according to claim 5, wherein the connecting piece is connected to the wire end by a clamping connection or crimp connection.

8. The electrical component according to claim 1, wherein the winding comprises two wire ends, and wherein the wire ends are bound in the same direction.

9. A component arrangement comprising:

the electrical component according to claim 1; and the mounting facility latched with the electrical component.

10. The component arrangement according to claim 9, wherein the mounting facility is a plate.

11. The component arrangement according to claim 9, wherein the connection area rests on a lower side of the mounting facility, and wherein the coil form or the winding rests on an upper side of the mounting facility.

12. The component arrangement according to claim 9, wherein the mounting facility is clamped between the connection area and the winding and/or the coil form.

13. A method for surface mounting, the method comprising:

producing the component arrangement according to claim 9;

providing a connection facility;

placing the connection area on the connection facility; and connecting the connection area to the connection facility.

14. A method for producing a component arrangement, the method comprising:

providing the electrical component according to claim 1; and providing the mounting facility;

arranging the mounting facility between the connection area and the coil form; and latching the connection area with the mounting facility.

15. An electrical component comprising:

a coil form and a winding of a wire around the coil form;

a connection area comprising a wire end of the wire, wherein the connection area is configured to latch with a mounting facility; and a connecting piece attached to the wire end, wherein the connecting piece is configured to latch.

16. The electrical component according to claim 15, wherein the connecting piece is a metallic strip.

17. The electrical component according to claim 15, wherein the connecting piece is connected to the wire end by a clamping connection or crimp connection.

* * * * *